United States Patent [19]

Cantwell

[11] Patent Number: 4,974,764

[45] Date of Patent: Dec. 4, 1990

[54] BELT CLIP

[76] Inventor: Alfred W. Cantwell, 278 Mohawk Trail, Buffalo Grove, Ill. 60089

[21] Appl. No.: 350,607

[22] Filed: May 11, 1989

[51] Int. Cl.[5] ..... A45F 5/00

[52] U.S. Cl. ..... 224/269; 224/904

[58] Field of Search ..... 224/269, 251, 252, 248, 224/253, 268, 904

[56] References Cited

U.S. PATENT DOCUMENTS

| | | | |
|---|---|---|---|
| 334,101 | 1/1886 | Buffum | 224/269 |
| 486,135 | 11/1892 | Stockdale et al. | 224/915 X |
| 1,206,074 | 11/1916 | Zwiener et al. | 224/252 |
| 1,270,158 | 6/1918 | Hill | 224/252 |
| 1,318,850 | 10/1919 | De Yong | 224/251 X |
| 1,326,887 | 12/1919 | Wood | 224/904 X |
| 1,618,573 | 2/1927 | Cole | 224/252 X |
| 2,320,067 | 5/1943 | Caughren | 224/268 X |
| 2,850,152 | 9/1958 | Murrufo | 224/253 |
| 3,104,434 | 9/1963 | Noordhoek | 224/904 X |
| 3,589,574 | 6/1971 | Marburger | 224/253 X |
| 3,963,156 | 6/1976 | Perrin | 224/268 |
| 3,990,617 | 11/1976 | Carter | 224/252 |
| 4,214,688 | 7/1980 | Griffin, Jr. | 224/197 |
| 4,453,656 | 6/1984 | Gillum | 224/247 |
| 4,457,462 | 7/1984 | Taormina | 224/269 |
| 4,524,892 | 6/1985 | Ozeki | 224/904 X |
| 4,587,818 | 5/1986 | Griffin | 70/457 |
| 4,784,199 | 11/1988 | Wise | 224/269 X |
| 4,821,934 | 4/1989 | Alessi et al. | 224/252 |
| 4,828,153 | 5/1989 | Guzik et al. | 224/904 X |

*Primary Examiner*—Renee S. Luebke

*Attorney, Agent, or Firm*—Olson & Hierl

[57] ABSTRACT

A belt clip for supporting a tool comprises a generally U-shaped member including a curved central portion, a first and a second leg connected to the central portion and an end portion of the first leg being movably connected to the curved central portion and being directed towards the second leg; and a curved member connected to the second leg, the curved member including a first section integral with and extending away from the second leg and a second section connected to the first section that curves back towards the second leg. The device can hold the tool in a stationary position so that the tool can be released from the clip without removal of the clip from the belt.

9 Claims, 1 Drawing Sheet

BELT CLIP

TECHNICAL FIELD

The present invention generally relates to a device for supporting a tool from the clothing of an individual and, in particular, to a belt clip for releasably supporting a tool such as a flashlight in a relatively stationary position.

BACKGROUND OF THE INVENTION

Numerous devices have been designed for attaching tools and other implements to articles of clothing including belts. However, most of those devices do not support the tool in a stationary position. If the tool is a flashlight, it would be particularly advantageous to support the flashlight from the belt with the light beam pointed in the desired direction. This would allow the user to carry other items while providing the necessary illumination.

When entering a darkened or smoke-filled area, an individual may need to carry tools in addition to a flashlight. The need for proper illumination in such situations is critical.

Currently, an individual must use one hand to keep the flashlight pointed in the desired direction. This means that only one hand is available for holding other tools or performing other tasks. Moreover, it sometimes requires two hands to remove a tool from a belt-mounted support. For example, a snap ring attached to a belt requires one hand to open the ring while the other hand removes the tool. This complicates an already difficult situation particularly if the individual must drop other items to release the snap ring.

These problems have demonstrated the need for a device that allows the easy attachment and removal of tools from a belt, but firmly supports the tool to keep it positioned as desired. Such a device would be beneficial for firemen and other public safety personnel, maintenance workers, divers and individuals for recreational or home use.

SUMMARY OF THE INVENTION

The present invention relates to a device which can be easily attached and removed from a belt and which releasably supports a tool in a relatively stationary position. The device is particularly useful for supporting a flashlight so that the light beam is pointed in the proper direction.

The device includes means for securing the clip on the belt and means for holding the tool in a stationary position. The securing means includes a loop for receiving the belt which comprises a curved central portion having a pair of opposite spaced-apart ends, a first leg and a second leg each being connected to one of the spaced-apart ends of the central portion and an end portion of the first leg which is directed towards the second leg. The central portion fits snugly over the top of the belt, whereas the two legs extend downwardly from the central portion in a generally parallel spaced-apart relationship to support the sides of the belt. An end portion at the lower end of the first leg is preferably bent or curved in the direction of the second leg to engage the bottom of the belt. This construction forms the loop that secures the device on the belt.

The means for holding the tool comprises a curved member connected to the second leg. The diameter of the curved member is sufficient to receive and firmly hold the handle of the tool. The curved member includes a first section that is integral with and extends away from the second leg and a second section connected to the first section that curves back towards the second leg. The second section also includes a flange portion that is resiliently urged towards the second leg.

In use, the handle of the tool is inserted within the curved member. The largest cross-sectional dimension of the handle of the tool should be less than the inside diameter of the curved member. The curved member thus firmly grasps the sides of the handle and supports the handle in a stationary position. The tool can be inserted and removed from the clip by applying finger pressure to the flange portion so that the flange portion is moved away from the second leg and by lifting upwardly on the tool without removal of the clip from the belt.

The first leg can include means for adjusting the length of the loop defined by the curved central portion, the first and second legs and the end portion to receive belts of various widths. Such adjusting means can include a top portion of the first leg which is integral with the central portion and a bottom portion of the leg which is slidably connected to the top portion.

Numerous other advantages and features of the present invention will become readily apparent from the description of the preferred embodiment, the drawings and the appended claims.

BRIEF DESCRIPTION OF THE DRAWINGS

In the drawings, which comprise a portion of the description of the present invention.

DESCRIPTION OF THE PREFERRED EMBODIMENT

Figure 1:
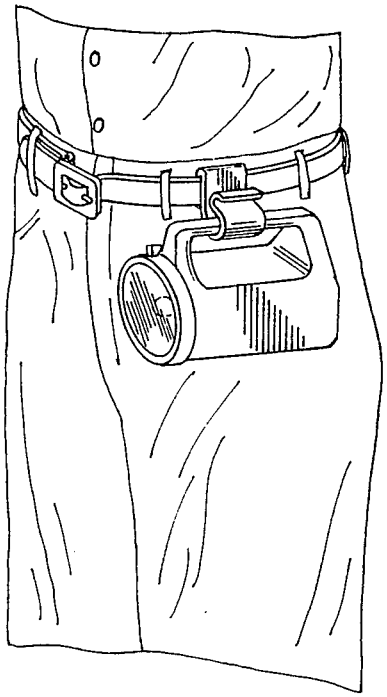
FIG. 1 is a perspective view which shows the belt clip supporting a flashlight on the belt of an individual.

Referring to FIG. 1, the present invention relates to a belt clip 10 for releasably securing a tool on a belt of an individual. The clip holds the handle of a tool to secure the tool in a predetermined position. As shown, the clip is particularly useful for supporting lantern-type flashlights in a stationary position with the light beam directed in a forward direction.

Figure 2:
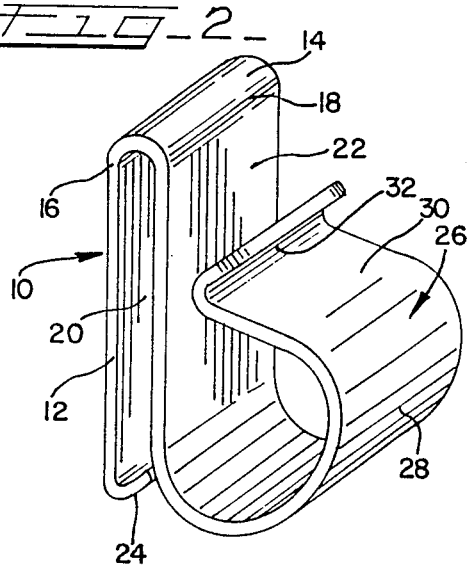
FIG. 2 is a perspective view of a preferred embodiment of the device.
Figure 3:
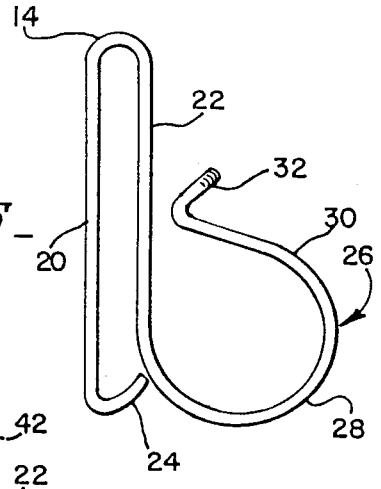
FIG. 3 is a side elevational view of the embodiment shown in FIG. 2.

The present device is shown more clearly in FIGS. 2 and 3. The device is preferably formed from a single plate of a resilient material such as a metal or plastic which is bent or molded into the described configuration.

One end of the plate comprises means for securing the clip on the belt. The securing means includes a loop 12 for receiving the belt comprising a curved central portion 14 having opposite, spaced-apart ends 16 and 18. A first leg 20 and a second leg 22 are connected to the opposite, spaced-apart ends 16 and 18, respectively, and extend in a generally parallel relationship therefrom.

The lower end of the first leg 20 includes an end portion 24 which forms the bottom section of the loop. The end portion 24 is bent or curved in the direction of the second leg 22, but is preferably spaced-apart from the second leg, to engage the bottom of the belt and secure the device on the belt. As will be explained in greater detail, the end portion 24 also prevents removal of the device from the belt when the tool is lifted from the clip.

The second end of the plate comprises means for holding the tool in a stationary position. The holding means comprises a curved member 26 which includes a first section 28 that is integral with the second leg 22 and includes a distal end that extends away from the second leg 22. A second section 30 of the curved member is connected to the distal end of the first section and curves back in the direction of the second leg. The second section includes a flange portion 32 which is resiliently urged towards the second leg 22. The flange portion 32 allows the user to bend the curved member 28 away from the second leg 22 to insert a tool handle within the holding means.

The typical handle of a lantern-type flashlight is rectangular in cross-section in that the width is somewhat greater than the thickness. Preferably, the inside diameter of the curved member 26 is somewhat less than of the cross-sectional width of the tool handle or the handle a lantern-type flashlight. This size difference along with the resiliency of the curved member 26 provides a firm grasp which allows the flashlight to be positioned as desired.

In the case of a lantern-type flashlight, the curved member 26 of the clip firmly holds the handle of the flashlight. However, by rotating the handle about 90 degrees away from the body of the individual and lifting the flashlight upwardly, the handle can be removed from the curved member 26 without disengaging the clip from the belt. Because the handle of this type of flashlight is generally U-shaped (as shown in FIG. 1) and the handle is rectangular in cross-section throughout its entire length, the flashlight can be readily positioned to aim the light beam upwardly, downwardly or straight ahead depending on the preference of the user.

The ability to position the flashlight with the beam directed upwardly or downwardly is useful in many situations including recreational activities such as diving or climbing. An individual can keep both hands free and still have illumination directed in the desired direction.

Figure 4:
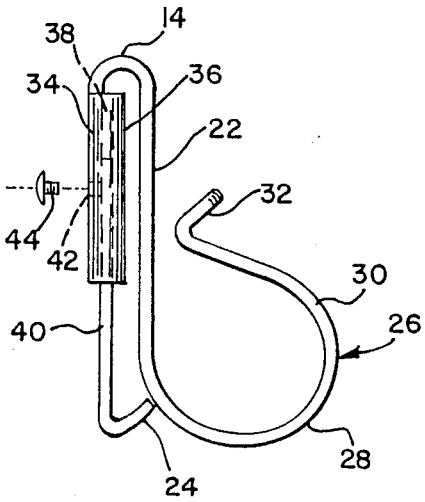
FIG. 4 is a side elevational view of a second embodiment of the device.
Figure 5:
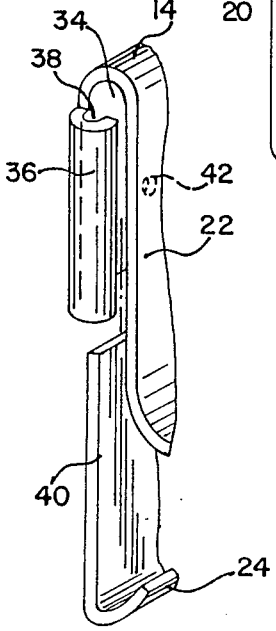
FIG. 5 is a partial perspective view of the embodiment shown in FIG. 4.

Another embodiment of the present invention is shown in FIGS. 4 and 5. In this embodiment, the first leg 20 is removably connected to the curved central portion 14. A top portion 34 of the first leg 20 is connected to the curved central portion 14 and includes a pair of bent portions or wings 36 which form a pair of channels 38 along the sides of the first leg. A bottom portion 40 of the first leg is adapted to be slidably received within the channels 38. This sliding arrangement allows the size of the loop 12 to be adjusted to accommodate belts of varying widths. The top portion 34 of the first leg can also include a threaded opening 42 adapted to receive a set screw 44 which is used to maintain the orientation of the bottom portion relative to the top portion and thus the size of the loop 12.

While this invention can be embodied in many different forms, the drawings and the specification generally relate to a preferred embodiment and various alternative embodiments. However, the disclosure includes examples of the construction of the device and is not intended to limit the invention to the embodiments illustrated.

Still other variations within the spirit and scope of this invention are possible and will readily present themselves to those skilled in the art. For example, this invention is easily adaptable for carrying and holding other objects or tools in addition to flashlights.

That which is claimed is:

1. A belt clip for supporting a tool on a belt comprising:

(a) means for securing the clip on the belt including a loop for receiving the belt which comprises a curved central portion having opposite spaced-apart ends, a first leg and a second leg connected to the opposite spaced-apart ends of the central portion and extending in a generally parallel relationship therefrom, the first leg being removably connected to the curved central portion, and an end portion of the first leg directed towards the second leg; and (b) means connected to the securing means for holding the tool in a stationary position whereby the tool can be released from the clip without removal of the clip from the belt.

2. The belt clip according to claim 1 wherein the curved central portion comprises a generally U-shaped member and the first and second legs are resilient.

3. The belt clip according to claim 1 wherein the end portion of the first leg is directed towards, but is spaced-apart from, the second leg.

4. The belt clip according to claim 1 wherein the holding means comprises a curved member connected to the second leg, the curved member including a first section integral with and extending away from the second leg and a second section connected to the first section that curved back towards the second leg and includes a flange portion resiliently urged towards the second leg, whereby the curved member is adapted to support a tool, the tool being inserted and removed by disengaging the flange portion from the second leg without removal of the clip from the belt.

5. A device for supporting a tool from a belt comprising:

(a) a generally U-shaped member including a curved central portion having a pair of spaced-apart opposite ends, a resilient first leg and a resilient second leg, the first and second legs being connected to the opposite ends of the central portion and extending generally downwardly therefrom with the first leg being removably connected to the curved central portion;

(b) an end portion of the first leg positioned opposite the central portion and directed towards the second leg, the U-shaped member, and the first and second legs and the end portion defining a loop for receiving the belt; and (c) a curved member connected to the second leg opposite the central portion, the curved member including (i) a first section integral with and extending away from the second leg opposite the first leg and having a distal end that extends towards the central portion and (ii) a second section connected to the distal end of the first section and curving back towards the second leg and including a flange portion resiliently urged towards the second leg, whereby the curved member is adapted to support a tool, the tool being inserted and removed by disengaging the flange portion from the second leg without removal of the device from the belt.

6. The device according to claim 5 wherein the end portion of the first leg is directed towards, but is spaced-apart from, the second leg.

7. A belt clip for supporting a tool from a belt comprising:

(a) means for securing the clip on the belt including a loop for receiving the belt which comprises a curved central portion having opposite spaced-apart ends, a first leg and a second leg connected to the opposite spaced-apart ends of the central portion and extending in a generally parallel relationship therefrom, the first leg including means for adjusting the length of the loop defined by the curved central portion, the first and second legs and the end portion to receive belts of various widths, and the adjusting means including a top portion of the first leg integral with the curved central portion and a bottom portion of the first leg slidably connected to the top portion, the bottom portion including the end portion of the first leg; and an end portion of the first leg directed towards the second leg; and (b) means connected to the securing means for holding the tool in a stationary position whereby the tool can be released from the clip without removal of the clip from the belt.

8. A device for supporting a tool from a belt comprising:

(a) a generally U-shaped member including a curved central portion having a pair of spaced-apart opposite ends, a resilient first leg and a resilient second leg, the first and second legs being connected to the opposite ends of the central portion and extending generally downwardly therefrom with the first leg including means for adjusting the length of the loop defined by the U-shaped member, the first and second legs and the end portion to receive belts of various widths;

(b) an end portion of the first leg positioned opposite the central portion and directed towards the second leg, the U-shaped member, and the first and second legs and the end portion defining a loop for receiving the belt; and (c) a curved member connected to the second leg opposite the central portion, the curved member including (i) a first section integral with and extending away from the second leg opposite the first leg and having a distal end that extends towards the central portion and (ii) a second section connected to the distal end of the first section and curving back towards the second leg and including a flange portion resiliently urged towards the second leg, whereby the curved member is adapted to support a tool, the tool being inserted and removed by disengaging the flange portion from the second leg without removal of the device from the belt.

9. The device according to claim 8, wherein the adjusting means including a top portion of the first leg integral with the curved central section and a bottom portion of the first leg slidably connected to the top portion, the bottom portion including the end portion of the first leg.

* * * * *